US009541321B2

(12) United States Patent
Lintker et al.

(10) Patent No.: US 9,541,321 B2
(45) **Date of Patent: *Jan. 10, 2017**

(54) PAN CHILLER SYSTEM HAVING LIQUID COOLANT IN DIRECT CONTACT WITH DIVIDING WALLS

(71) Applicant: ILLINOIS TOOL WORKS INC., Glenview, IL (US)

(72) Inventors: Jason C. Lintker, Webster Groves, MO (US); Mark C. Curran, Rancho Santa Margarita, CA (US); James W. Stone, Northbrook, IL (US); Alan J. Varacins, Burlington, WI (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/719,840

(22) Filed: May 22, 2015

(65) Prior Publication Data

US 2015/0253062 A1 Sep. 10, 2015

Related U.S. Application Data

(63) Continuation of application No. 12/298,669, filed as application No. PCT/US2007/009631 on Apr. 19, 2007, now Pat. No. 9,068,773.

(60) Provisional application No. 60/860,449, filed on Nov. 20, 2006, provisional application No. 60/795,517, filed on Apr. 27, 2006.

(51) Int. Cl.

| | |
|---|---|
| ***F25D 23/12*** | (2006.01) |
| ***F25D 17/02*** | (2006.01) |
| ***A47F 3/04*** | (2006.01) |
| ***F25D 23/06*** | (2006.01) |
| *A47F 10/06* | (2006.01) |
| *F25D 15/00* | (2006.01) |

(52) U.S. Cl.

CPC ..... *F25D 17/02* (2013.01); *A47F 3/0469* (2013.01); *A47F 3/0486* (2013.01); *F25D 23/061* (2013.01); *A47F 10/06* (2013.01); *F25D 15/00* (2013.01); *F25D 2400/08* (2013.01)

(58) Field of Classification Search

CPC ..... F25D 17/02; F25D 23/06; F25D 23/063; F25D 2400/08; A47F 3/0486; A47F 10/06

See application file for complete search history.

(56) References Cited

U.S. PATENT DOCUMENTS

| | | | |
|---|---|---|---|
| 1,932,694 | A | 10/1933 | Gray |
| 1,968,812 | A | 8/1934 | Ackerman |
| 2,321,695 | A | 6/1943 | Miller |

(Continued)

FOREIGN PATENT DOCUMENTS

WO WO-01/92129 A1 * 12/2001 ..... F25D 23/06

*Primary Examiner* — Orlando E Aviles Bosques

(74) *Attorney, Agent, or Firm* — Thompson Hine LLP

(57) ABSTRACT

A pan chiller system including a refrigeration package having a condensing unit, a heat exchanger and a pump for circulating a chilled liquid coolant, a pan chiller unit in communication with the refrigeration package and having an outer housing and a food well received within the outer housing and a plurality of hollow divider bars arranged within the food well. An opening is defined between adjacent divider bars, wherein each divider bar is configured for directly receiving the liquid coolant chilled and circulated by the refrigeration package.

10 Claims, 5 Drawing Sheets

(56) References Cited

U.S. PATENT DOCUMENTS

| | | | |
|---|---|---|---|
| 2,346,430 | A | 4/1944 | Hauser |
| 2,667,761 | A | 2/1954 | Sellstrom |
| 2,877,000 | A | 3/1959 | Person |
| 3,952,794 | A | 4/1976 | Spanoudis |
| 4,280,335 | A | 7/1981 | Perez et al. |
| 4,760,711 | A | 8/1988 | Kopatz et al. |
| 4,856,579 | A | 8/1989 | Wolfe |
| 5,117,649 | A | 6/1992 | Mangini et al. |
| 5,168,712 | A | 12/1992 | Coelho et al. |
| 5,355,687 | A | 10/1994 | Carpenter et al. |
| 5,671,808 | A | 9/1997 | Kleyn |
| 5,921,096 | A | 7/1999 | Warren |
| 5,927,092 | A | 7/1999 | Kushen et al. |
| 6,185,951 | B1 | 2/2001 | Lane et al. |
| 6,253,668 | B1 | 7/2001 | Lee |
| 6,313,990 | B1 | 11/2001 | Cheon |
| 6,541,739 | B2 | 4/2003 | Shei et al. |
| 6,963,488 | B1 | 11/2005 | Chen |
| 2005/0047083 | A1 | 3/2005 | Kondo et al. |
| 2005/0166631 | A1 | 8/2005 | Trujillo, Jr. et al. |
| 2006/0053805 | A1 | 3/2006 | Flinner et al. |

* cited by examiner

PAN CHILLER SYSTEM HAVING LIQUID COOLANT IN DIRECT CONTACT WITH DIVIDING WALLS

Applicant claims priority benefits under 35 U.S.C. §120 as a continuation application based on U.S. Ser. No. 12/298,669 filed Mar. 9, 2009, which claims priority under 35 U.S.C. §119 on the basis of Patent Applications Nos. 60/795,517, filed Apr. 27, 2006 and 60/860,449, filed Nov. 20, 2006.

BACKGROUND

The present cooling system relates to the food industry, and more particularly, to a pan chiller system for providing uniform cooling to food pans provided in a food well.

In the food service industry, it is important to maintain food at desired temperatures in food pans to preserve food freshness. Accordingly, pan cooling/chilling systems have been developed, such as those disclosed in U.S. Pat. Nos. 5,355,687 and 5,927,092 and commonly-owned U.S. Provisional Patent Application No. 60/860,449, which are herein incorporated by reference in their entirety.

One problem experienced by current chilling systems is damage to the electrical components or wiring located within or in close proximity to the food pans due to condensation and/or spilled food dripping on the components or on the wiring. Excessive condensation especially results in cooling energy transfer inefficiency and possible premature component failure due to the extra work needed to achieve sufficient cooling.

For example, in many current systems, the generally copper tubing cooling element is provided below the food pans. Condensation on the relatively cold tubing results in frost forming on the tubing, reducing heat transfer efficiency of the system. To remove such frost, many current systems will periodically increase the temperature of the coolant within the tubing, causing the frost to melt and drip into the bottom of the unit, requiring disassembly of the unit for cleaning, which can cause damage to the wiring and increases system down time.

Also, current chilling systems generally are based on a Freon system that requires a change of state from liquid to gas to extract heat. Accordingly, they operate at a pressure of as much as 300 psi. This relatively high operating pressure requires expensive piping and fittings. A further issue in current chilling systems is their use of Freon as the coolant, which may be considered hazardous to the ozone layer if leaked to the atmosphere.

Another problem experienced by many current chilling systems is the inability to uniformly cool the food pans. Excessive or uneven cooling may damage many types of high moisture foods if the temperature drops below the freezing point of water, especially near the wall of the pan. One attempt to resolve this issue is to include a fan located in close proximity to the food pans for circulating air around an outside of the food pans in the sub-pan cooling unit. However, in practice, condensation and food spillage can result in damage to the fan and associated components.

Many current pan chilling systems utilize a cold-wall design, in which refrigeration lines are mounted in direct contact with the interior walls of the food well, and refrigerant is pumped through the lines. As the refrigerant evaporates, these interior walls serve as a heat sink for the enclosure surrounding the food pans. However, it has been found that in a cold-wall design, generally the pans around the perimeter of the food well opening are adequately cooled, but the coolant does not adequately chill the pans located in the center of the opening. Attempts to adequately cool food located in the center of the pan and/or food well opening typically involves lowering the coolant temperature in these systems. However, while this may cool the food provided in the center of the opening, it can cause the food closer to the perimeter of the opening to freeze.

To reduce ice or frost build-up and operate efficiently, current pan chilling systems employ a defrost cycle generally once an hour or overnight. During the defrost cycle, the chilling system operates at a higher temperature to remove the frost build-up, which can reduce the performance of the system because the food pans generally need to be removed prior to the defrost cycle.

Accordingly, there is a need for an improved pan chilling system that addresses the inefficiencies caused by condensation and/or food spillage forming on the coolant lines, and that provides more uniform and efficient cooling to the entire system. In addition, there is a need for an improved chilling system employing a coolant that is relatively environmentally friendly. Further, there is a need for an improved chilling system that more efficiently cools the individual food pans. Also, there is a need for an improved chilling system that prevents condensation, ice or moisture buildup on and around the food pans and the food well. There is a further need for an improved chilling system that can be easily manufactured and modified to suit the application.

SUMMARY

The above-listed needs are met or exceeded by the present pan chiller system with glycol, which features a possibly remote chilling system including a plurality of divider bars each configured for directly receiving a coolant without the need for piping within the divider bar. The present system provides an increased flow rate of a generally higher temperature coolant that does not change state. This provides a more consistent temperature throughout the system and decreased pressure to prevent leakage, allowing for easier assembly and use of plastic piping. Also, the present system utilizes a flooding-type, high-flow chilled glycol solution that is environmentally friendly, absorbs heat and experiences significantly smaller temperature changes than the Freon coolant that does change state and is used in many current systems, preventing ice or moisture buildup. Further, the present pan chilling system is modular and can be easily manufactured and assembled relative to current systems. In addition, the present system does not include any electrical components or wiring within the food well, therefore reducing the chances of contamination or damage to the components, and reducing capital and maintenance costs.

More specifically, the present pan chiller system preferably includes a refrigeration package having a condensing unit, a reservoir or heat exchanger, and a pump. The system further includes a pan chiller unit in communication with the refrigeration package and having an outer housing and a food well received within the outer housing. A plurality of hollow divider bars are arranged within the food well and an opening is defined between adjacent divider bars, wherein each divider bar is configured for directly receiving a coolant chilled and circulated by the refrigeration package.

DETAILED DESCRIPTION

Figure 1:
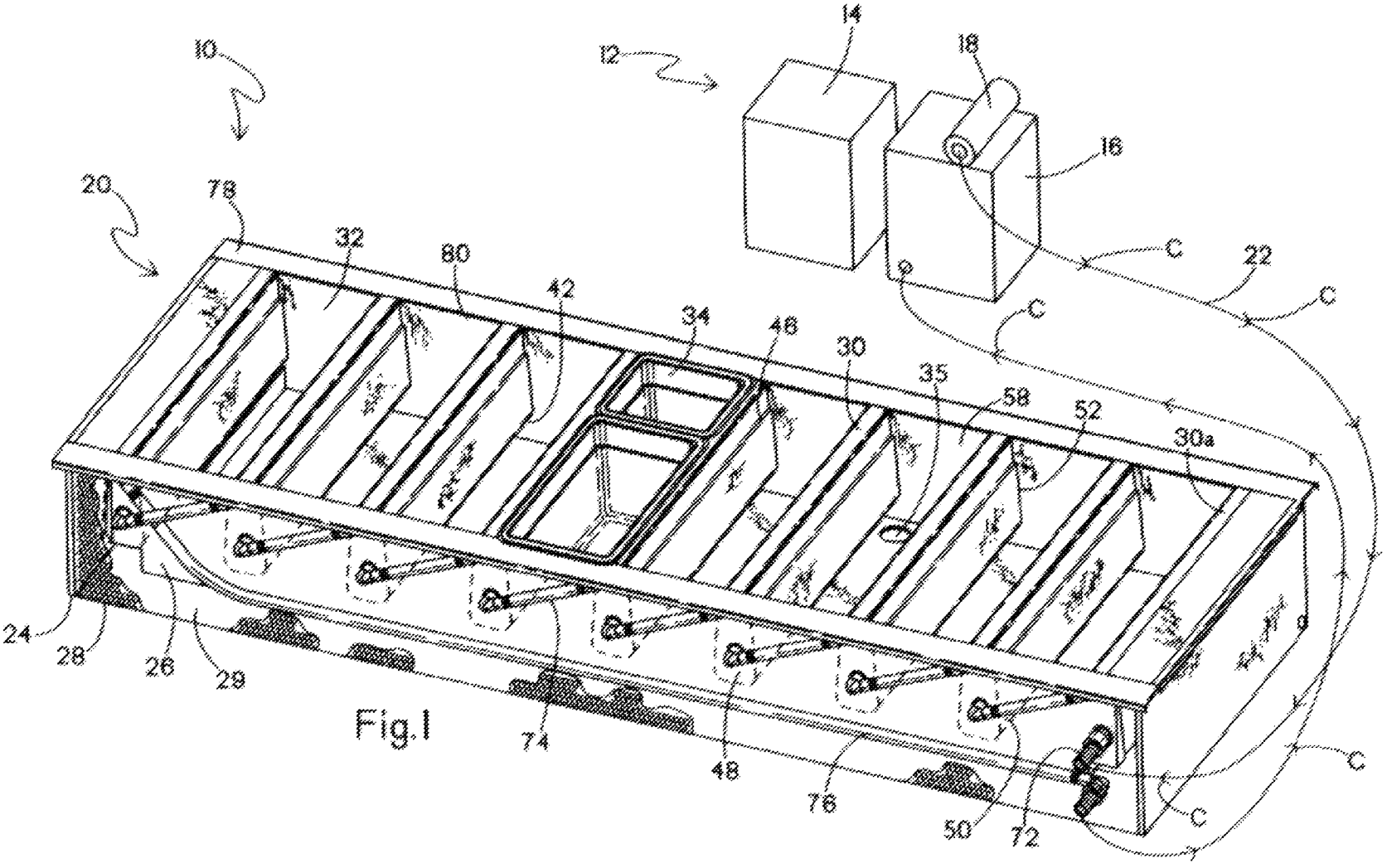
FIG. 1 is a top perspective view of the present pan chiller system with portions removed for clarity.

Referring to FIG. 1, a pan chiller system is generally designated 10 and includes a refrigeration package 12 having a condensing unit 14, a reservoir or heat exchanger 16, a pump 18, and a pan chiller unit 20 preferably remotely located from, and in communication with, the refrigeration package. Preferably, the refrigeration package 12 is provided in a location removed from the kitchen such as an outdoor location, in a false ceiling or on a roof of a building/restaurant, and is connected to the pan chiller unit 20 by tubing or piping 22. Accordingly, electric motors, pumps, compressors and electronic control components such as thermostats are located in the remote refrigeration package 12, and not in the pan chiller unit 20 or its components, in contrast to many current systems. It can be appreciated that this arrangement prevents contamination from condensing moisture or dripping food from forming on the electrical components because they are not exposed to the kitchen environment.

Figure 2:
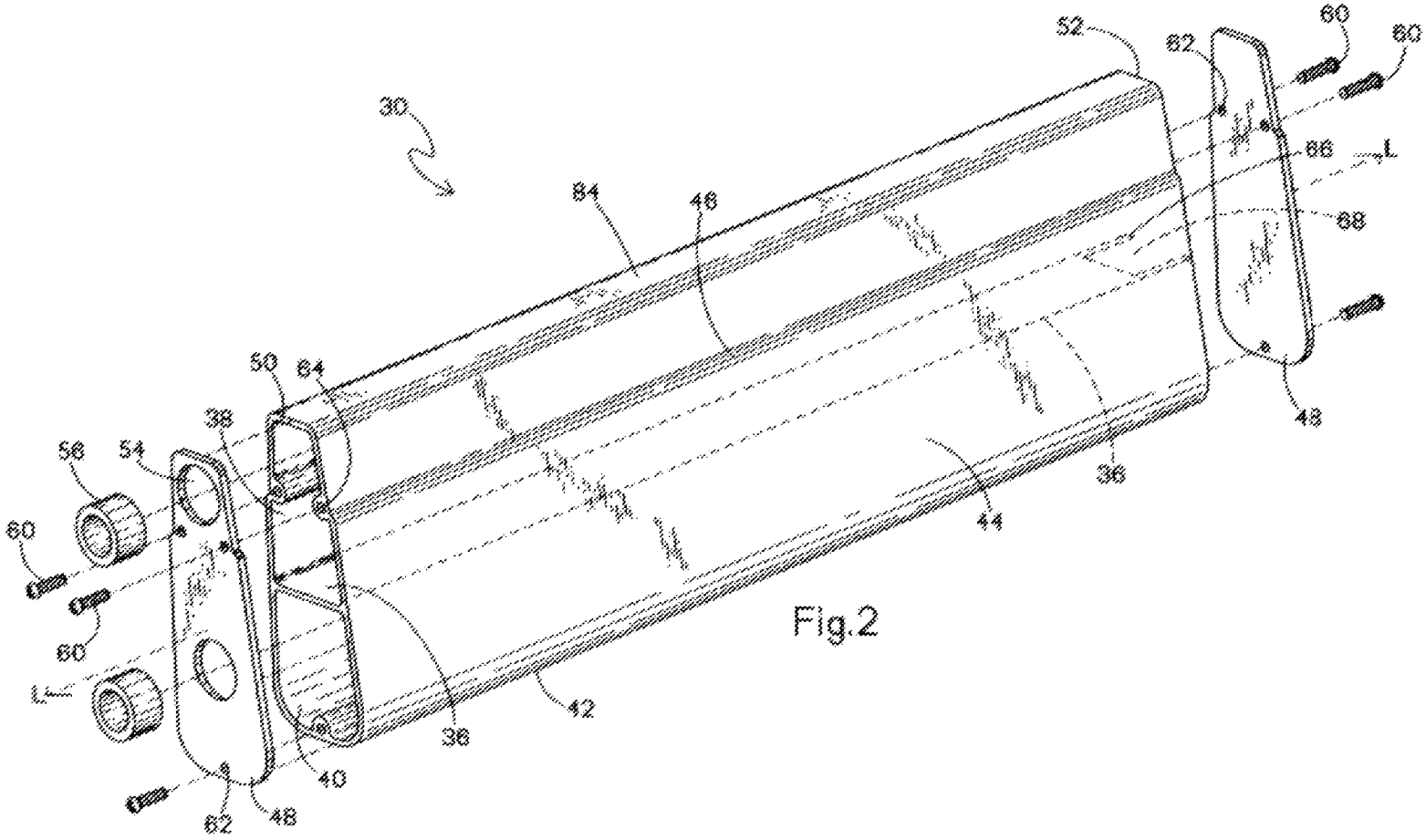
FIG. 2 is an exploded top perspective view of a divider bar of the pan chiller system shown in FIG. 1.
Figure 3:
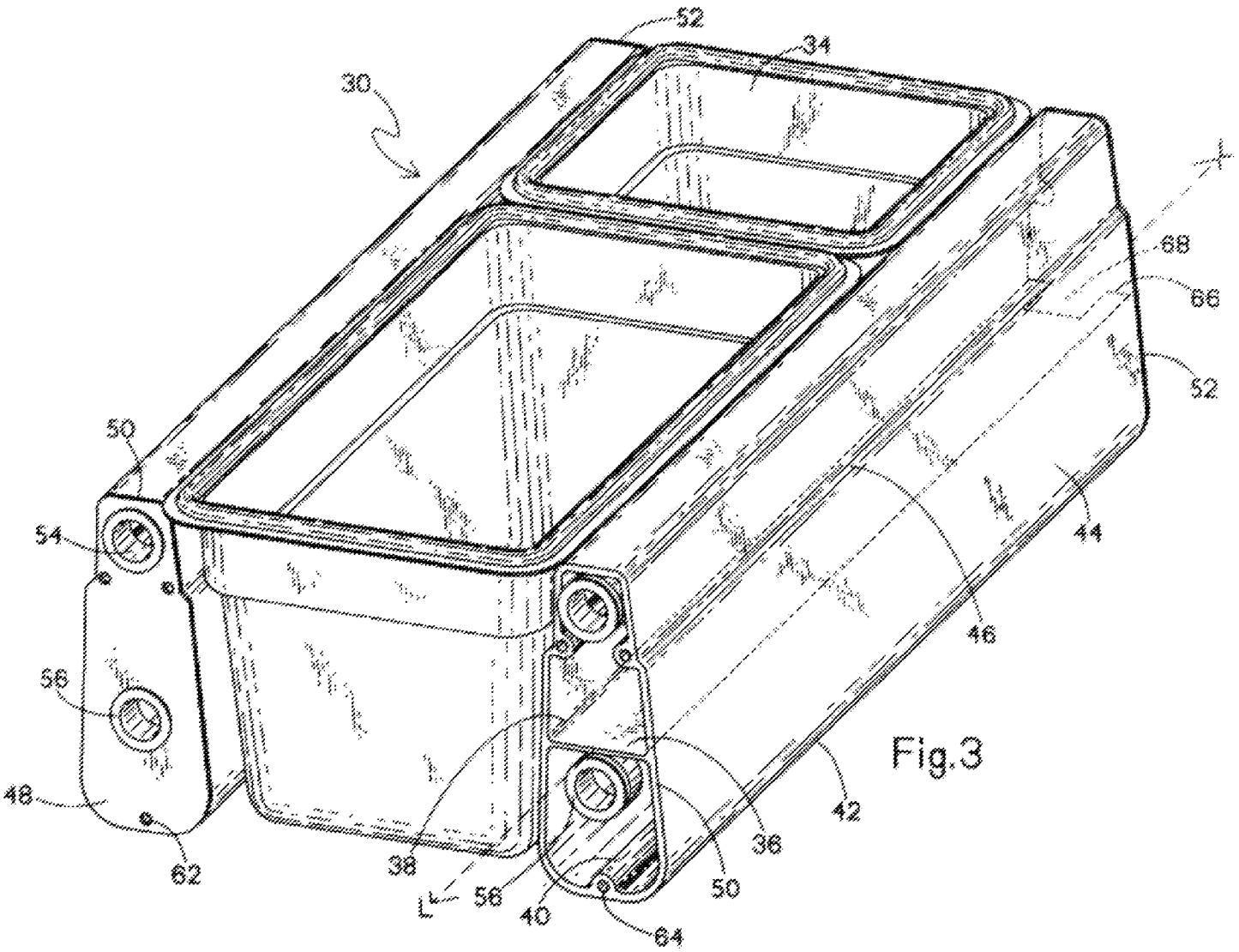
FIG. 3 is a fragmentary top perspective view of the pan chiller system shown in FIG. 1.

Referring to FIGS. 1-3, the pan chiller unit 20 includes a generally box-like outer housing 24, a deep tray-like inner housing or food well 26 placed within the outer housing and insulating material 28 preferably disposed in a cavity 29 between the two housings 24, 26. The pan chiller unit 20 may be associated with a kitchen operating station and elevated from the floor. A plurality of divider bars 30 are arranged generally parallel to each other within the food well 26 and an opening 32 is defined between adjacent divider bars. The divider bars 30 are preferably extruded of a unitary piece of aluminum or similar metal, as known in the art, although other methods of manufacture may be appropriate. Individual food pans 34 are configured for being received in the openings 32.

Because there are no electrical components within the pan chiller unit 20, and because the divider bars 30 are unitarily formed unlike many current systems having divider bars formed of several components that can freeze at their attachment seams, it is contemplated that the food well 26 and divider bars 30 can easily be cleaned without causing damage to wiring or electronics, even during operation. To further ease cleaning, a wall of the food well 26 can include a drain 35 (FIG. 1) for removing drippings from the food pans 34 or other moisture that may form during operation or cleaning.

Referring now to FIG. 2, each divider bar 30 is preferably substantially hollow and includes an internal rib 36 constructed and arranged for dividing the bar 30 into an upper channel 38 and a lower channel 40. Preferably, the rib 36 is arranged generally parallel to a bottom 42 of the divider bar 30, and extends along a longitudinal axis "L" of the bar.

Preferably, a transverse cross-sectional profile of the divider bars 30 is trapezoidal, with a narrower width at an upper end relative to a wider lower end. This configuration provides inclined walls for the food pan opening 32 for easily accommodating the food pans 34 while keeping the walls of the divider bars 30 as close to the walls of the food pans as possible for efficient heat transfer. However, it is recognized that other shapes for the divider bars 30 may be suitable depending on the application, especially different shaped food pans 34. Preferably still, an outer shell 44 of the divider bar 30 includes a stepped groove 46 extending parallel to the longitudinal axis "L" of the divider bar. It is contemplated that the groove 46 enables the divider bar 30 to accommodate a greater variety of food pans 34, although it is recognized that other configurations may be appropriate.

It is contemplated that the present system 10 is modular, and accordingly, a length or profile of the divider bars 30 can be custom made to properly fit and accommodate different shapes/sizes of food pans 34 to obtain a close, complementary fit between the divider bar and the pans for enhanced heat transfer. Alternatively, if the divider bar 30 is not custom made, a small gap (not shown) is generally present between the bars 30 and the food pans 34. Although direct contact provides advantageous heat transfer, with the present, constant flow system, such a small gap does not significantly impede heat transfer because it leads to "sweating", or the formation of water in the gap, which aids in heat transfer. A related advantage of the present system is that a coolant C is cycled to stay around the freezing point of water to prevent frost or ice buildup.

Referring now to FIGS. 2 and 3, the divider bar 30 further includes a pair of endcaps 48 constructed and arranged for covering a first end 50 and a second, opposite end 52 of the divider bar. The endcaps 48 are preferably manufactured from laser-cut or stamped aluminum, although other materials may be appropriate. To ensure proper sealing between the endcaps 48 and the divider bar 30, the endcaps are preferably welded or dip brazed to the divider bar, as known in the art. Preferably, one of the endcaps 48 defines at least one, and preferably a pair, of generally circular openings 54 constructed and arranged for receiving a corresponding conduit 56. Each of the openings 54 is aligned with one of the upper and lower channels 38, 40, as shown in FIG. 3. Each conduit 56 is in fluid communication with the tubing 22 and is configured for transporting the coolant C either into or out of the divider bar 30.

As shown in FIGS. 1 and 2, the divider bars 30 are secured at each end 50, 52 to a food well sidewall 58 by at least one, and preferably three fasteners 60 which are inserted into food well 26 through apertures (not shown), endcap through holes 62 and divider bar through openings 64, respectively. It is contemplated that this arrangement provides a modular assembly that is easier to assemble, disassemble and customize than current chiller systems. Orientation of the divider bars 30 can be changed from parallel to transverse or angular to the sidewalls. Non-horizontal mounting is also contemplated. Although this is the preferred arrangement, is appreciated that other manufacturing and mounting configurations may be suitable, depending on the application.

In an alternate arrangement (not shown), the end cap 48 is manufactured from a thermoplastic material, and a suitable seal such as an O-ring or gasket is provided between the end cap and the divider bar 30. However, it is recognized that other alternate sealing arrangements may be suitable, as known in the art.

To enable the coolant C to flow through both the upper and lower channels 38, 40 and as shown in FIGS. 2 and 3, an edge 66 (shown hidden) of the internal rib 36 includes a cutout 68 (shown hidden) constructed and arranged for enabling fluid communication between the upper and lower channels 38, 40. The cutout 68 is preferably provided at the second end 52 of the divider bar 30.

Each channel 38, 40 is configured for directly receiving the coolant "C", shown with arrows in FIG. 1. The coolant "C" is preferably propylene glycol (referred to herein as glycol), or a similar single state coolant having a freezing point below that of water, such as a brine saltwater solution. However, it should be appreciated that other coolants with similar properties may be acceptable, depending on the application.

Since the divider bars 30 have a large surface area and the flow rate of the glycol is high, it can achieve sufficient cooling without having to change state. It also can flow at a higher temperature and greater flow rate than Freon, generally flowing through the divider bars 30 at a temperature between 27-33° F., which will be described in further detail below. Accordingly, glycol provides more efficient and uniform cooling throughout the system.

It is contemplated that due to the hollow, relatively unobstructed internal construction of the bar 30, the coolant C flows such that the upper and lower channels 38, 40 will remain full of coolant throughout operation, and any excess air will be purged, thus cooling the food pans 34 uniformly from top to bottom.

Specifically, and as indicated by the arrows C in FIG. 1, during operation of the system 10, the glycol coolant is pumped from the heat exchanger 16 by the pump 18, and is sent to a supply pipe 72. The coolant C travels through the lower channel 40 of a first divider bar 30*a* and upwardly through the notch 68, where it then flows through the upper channel 38. The coolant C then flows into a connecting pipe 74 that connects the upper channel 38 with the lower channel 40 in an adjacent divider bar 30. This flow process continues until the coolant C has traveled through each divider bar 30, at which point it exits a return pipe 76 and returns to the heat exchanger 16.

It can be appreciated that in the present system the flowing glycol coolant is in direct contact with the entire inner surface area of the divider bar. An additional feature of the present system 10 is that the coolant C is continuously flowing and accordingly maintains a steady liquid state each time it reenters the heat exchanger 16 after passing through each of the divider bars 30 and exits the pan chiller unit 20. During operation, the glycol coolant flow pressure within the divider bar 30 is generally between 5-40 psi, which is significantly lower than the as much as 300 psi pressure found in current Freon-based chilling systems, which generally require copper or similar tubing to withstand such pressure. By operating at a lower pressure in a constant liquid state, simple plastic piping and related fittings of the type used in conventional low pressure fluid flow systems can be used for the delivery system of the system 10. Also, the run time of the present refrigeration package 12 is reduced because the heat transfer efficiency of the present system 10 is relatively higher than conventional systems.

It is also contemplated that by providing a continuous flow of the steady state coolant C through the divider bars 30, the change in temperature from the first divider bar 30*a* to the last divider bar is relatively small. The glycol in the present system 10 is maintained by the refrigeration unit 12 at a relatively higher temperature than conventional pan chiller systems, preferably continuously cycling near the freezing point of water. Specifically, the coolant temperature continuously cycles or fluctuates above and below the freezing point of water, and most preferably between 27-33° F. The coolant C preferably peaks above the freezing point of water to provide a frost-free system. Further, with a sufficient and continuous flow of glycol, it is contemplated that the entire surface of the divider bars 30 can be maintained at a uniform temperature which is relatively higher than Freon-based systems, thus being more energy efficient and requiring less maintenance. In addition, by constantly running the pump 18 to continuously cycle the coolant C, it is contemplated that the present system is more cost efficient and easier to control than many current Freon-based systems, which generally require a compressor to regularly be turned on and off to regulate the temperature of the Freon.

To remove the frost build-up formed in many current Freon-based chiller systems and to operate at optimal conditions, defrosting is typically required for at least one hour in each 24-hour cycle, disrupting the flow of the coolant and raising the temperature within the cooling elements. Such systems also require timers and must schedule the defrosting when the unit is not in use. However, in the present system 10, it is contemplated that any light frost buildup that may form can be changed to water due to the above-described cycling of coolant. Specifically, if the glycol temperature is raised to above the freezing point of water for a short period of time, but never above the food temperature, the frost can melt yet the system continues cooling. However, due to the constant cycling of the coolant in the present system 10, the food is not heated. In the present system 10, because there is no defrost cycle, the glycol continues to flow and cool the system, and accordingly it is contemplated that the efficiency of the system remains consistent.

Figure 4:
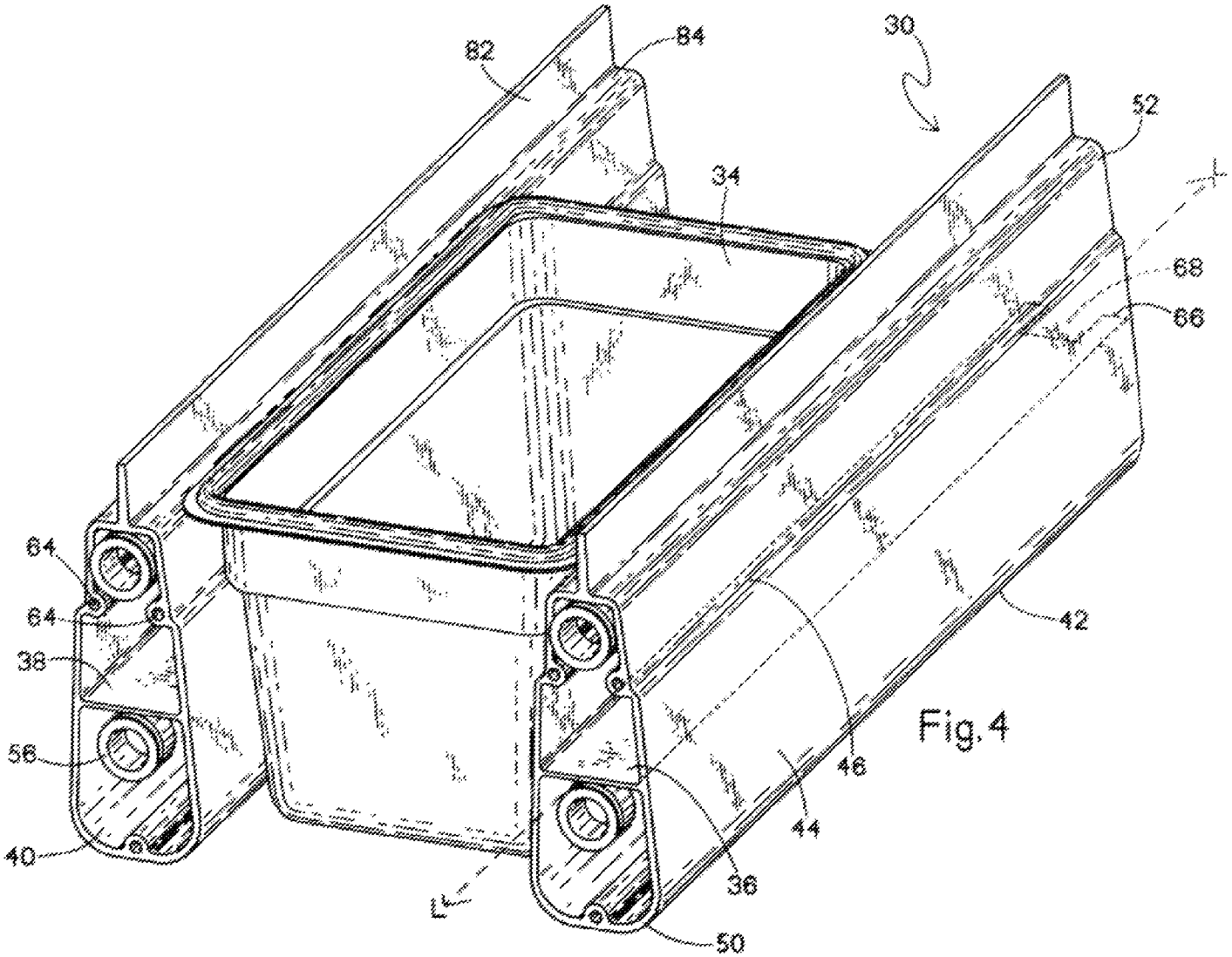
FIG. 4 is a fragmentary top perspective of an alternate embodiment of the present pan chiller system.
Figure 5:
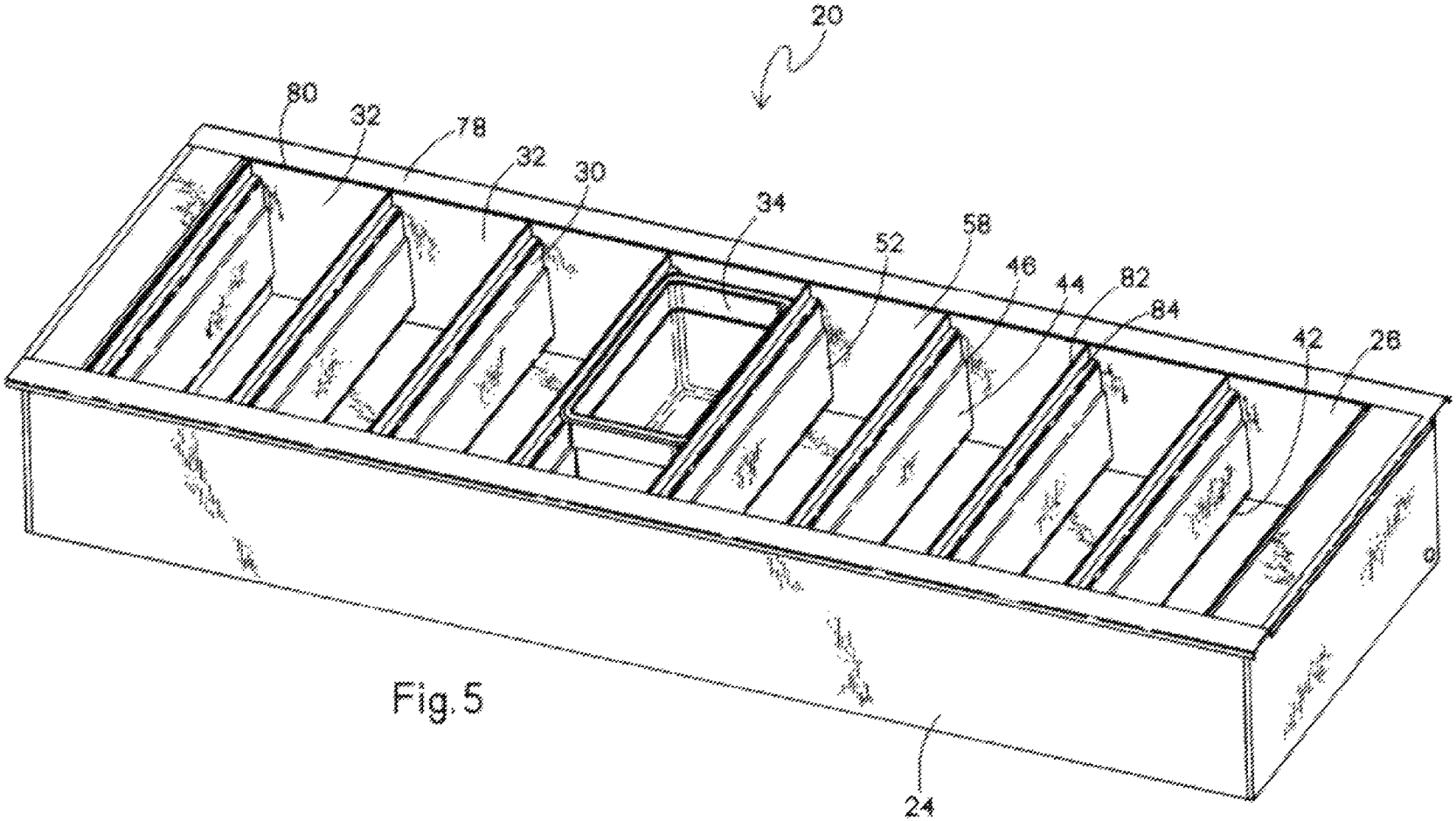
FIG. 5 is a top perspective view of the alternate embodiment of the system in FIG. 4.

To further ensure uniform cooling of the food pans 34, especially in the center of the food pans, an upper peripheral wall 78 is provided at a sufficient height such that it surrounds a top periphery 80 of the pan chiller unit 20, as shown in FIG. 1. It is contemplated that the height of the wall 78 will help keep the cold air in the unit 20 to maintain a steady and cool temperature in the pans 34. Additionally, and as seen in FIGS. 4 and 5, the divider bar 30 optionally includes a fin 82 vertically extending from a top portion 84 of the divider bar, and also extending parallel to the longitudinal axis "L" of the bar. The fins 82 are preferably arranged parallel to each other, and each preferably extends approximately one inch from the top portion 84, although other dimensions are contemplated. Preferably still, the fin 82 is centrally located on the top portion 84, although other locations may be suitable.

It is contemplated that the fin 82 acts as a heat sink to create an insulation barrier above the food pans 34 by forming a stagnant blanket of cooled air over the chilling pan unit 20. The upper peripheral wall 78 along with the fin(s) 82 aid in keeping the cooled air within the perimeter of the unit and enable proper cooling of the food pans 34, even those centrally located within the well 26. Because of the unitary formation of the divider bars 30, the fin 82 is a supplemental cooling device which does not add significant cost to the manufacturing process. To further ensure steady cooling, the fin 82 preferably extends at least as high as the top periphery 80 of the well 26, preventing escape of the cool air.

While a particular embodiment of the present pan chiller system with single state coolant has been described herein, it will be appreciated by those skilled in the art that changes and modifications may be made thereto without departing from the invention in its broader aspects and as described below.

The invention claimed is:

1. A pan chiller system comprising: a refrigeration package having a condensing unit, a heat exchanger and a pump for circulating a chilled liquid coolant such that the coolant remains in its liquid state during operation of said system;

a pan chiller unit in fluid communication with said refrigeration package and having an outer housing and a food well received within the outer housing;

a plurality of hollow divider bars arranged within said food well and an opening is defined between adjacent divider bars, wherein each divider bar is configured for directly receiving the liquid coolant chilled and circulated by said refrigeration package, each divider bar includes an internal rib segmenting said divider bar into an upper channel vertically displaced from a lower channel, said upper and lower channels are longitudinally encircled and defined by walls of said divider bar and said internal rib along a flow path of said coolant;

an edge of each said internal rib includes a cutout constructed and arranged at an end of said divider bars for receiving said coolant and for enabling flow between said upper and lower channels, said cutout encircled and defined by walls of said divider bars; and said divider bar walls enclosing said upper and lower channels, having a first surface being in direct contact with the coolant, and an outer shell opposite said first surface, being configured for directly supporting a food pan.

2. A pan chiller system for a pan chiller unit for circulating a chilled liquid coolant, the system being configured such that the coolant remains liquid during operation of the system, the pan chiller unit having an outer housing, and a food well received within the outer housing, including:

a plurality of hollow divider bars configured for directly receiving the chilled liquid coolant being circulated by the pan chiller system and arranged generally parallel to each other within the food well and an opening is defined between adjacent hollow divider bars, wherein each hollow divider bar includes:

a top portion;

a fin vertically extending from the top portion;

a hollow bar longitudinal axis;

said fin extending along a fin longitudinal axis parallel to the hollow bar longitudinal axis; and said fin creating shoulders on the top portion on both opposite sides of said fin along the fin longitudinal axis, wherein said fin extends generally vertically toward a top periphery of said food well, and is centrally located on said top portion;

spaced apart walls;

an upper channel;

a lower channel; and an internal rib extending between and connecting the spaced apart walls to create said upper channel and said lower channel through which the chilled liquid coolant flows and is in direct contact with an interior surface of said spaced apart walls, an end of the upper channel including a coolant flow opening and an end of the lower channel including a coolant flow opening, the internal rib including an upper surface and a lower surface, wherein the chilled liquid coolant flowing through the upper channel is in direct contact with the upper surface of the internal rib, and the chilled liquid coolant flowing through the lower channel is in direct contact with the lower surface of the internal rib; and wherein the chilled liquid coolant flows through the upper channel and the lower channel of each of said hollow divide bars before leaving each of said hollow divider bars.

3. A pan chiller system comprising:

a housing within a food well, the food well formed in part by a first hollow divider bar and a second hollow divider bar arranged generally parallel to and spaced apart from the first hollow divider bar to provide a food pan receiving opening between the first hollow divider bar and the second hollow divider bar, wherein the first hollow divider bar includes a first internal rib extending between and connecting spaced apart walls of the first hollow divider bar to divide the first hollow divider bar into a first upper channel for flowing chilled liquid coolant and a first lower channel for flowing chilled liquid coolant, wherein the first internal rib includes an upper surface and a lower surface, wherein chilled liquid coolant flowing through the first upper channel is in direct contact with the upper surface of the first internal rib, chilled liquid coolant flowing through the first lower channel is in direct contact with the lower surface of the first internal rib; wherein the chilled liquid coolant flows through the first upper channel and the first lower channel before leaving the first hollow divider bar;

wherein the second hollow divider bar includes a second internal rib extending between and connecting spaced apart walls of the second hollow divider bar to divide the second hollow divider bar into a second upper channel for flowing chilled liquid coolant and a second lower channel for flowing chilled liquid coolant, wherein the second internal rib includes an upper surface and a lower surface, wherein chilled liquid coolant flowing through the second upper channel is in direct contact with the upper surface of the second internal rib, chilled liquid coolant flowing through the second lower channel is in direct contact with the lower surface of the second internal rib; and wherein the chilled liquid coolant flows through the second upper channel and the second lower channel before leaving the second hollow divider bar.

4. The pan chiller system of claim 3, further comprising:

a flow connection between the first hollow divider bar and the second hollow divider bar for flowing chilled liquid coolant from the first hollow divider bar to the second hollow divider bar.

5. The pan chiller system of claim 4 wherein the flow connection runs from the first upper channel to the second lower channel.

6. The pan chiller system of claim 4 wherein:

an end of the first upper channel includes a coolant flow opening and an end of the first lower channel includes a coolant flow opening;

an end of the second upper channel includes a coolant flow opening and an end of the second lower channel includes a coolant flow opening.

7. The pan chiller system of claim 6 wherein chilled liquid coolant flows into the coolant flow opening of the first lower channel, along the first lower channel, up into the first upper channel, along the first upper channel, out through the coolant flow opening of the first upper channel, along the flow connection and into the coolant flow opening of the second lower channel, along the second lower channel, up into the second upper channel, along the second upper channel and out through the coolant flow opening of the second upper channel.

8. The pan chiller system of claim 3 wherein chilled liquid coolant flows in one direction along the first hollow divider bar through the first lower channel and in an opposite direction along the first hollow divider bar through the first upper channel.

9. The pan chiller system of claim 8 wherein chilled liquid coolant flows in one direction along the second hollow divider bar through the second lower channel and in an opposite direction along the second hollow divider bar through the second upper channel.

10. The pan chiller system of claim 3 wherein:

the first hollow divider bars includes a first fin extending vertically upward and along a longitudinal axis of the first hollow divider bar to create shoulders on both opposite sides of the first fin;

the second hollow divider bars includes a second fin extending vertically upward and along a longitudinal axis of the second hollow divider bar to create shoulders on both opposite sides of the second fin.

* * * * *